US006367446B1

(12) United States Patent
Kanamaru et al.

(10) Patent No.: US 6,367,446 B1
(45) Date of Patent: Apr. 9, 2002

(54) INTERNAL COMBUSTION ENGINE CONTROL APPARATUS AND METHOD

(75) Inventors: Masanobu Kanamaru, Mishima; Satoru Watanabe, Susono, both of (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/558,858

(22) Filed: Apr. 27, 2000

(30) Foreign Application Priority Data

Apr. 27, 1999 (JP) ..... 11-119239

(51) Int. Cl.[7] ..... F02M 3/00

(52) U.S. Cl. ..... 123/339.12; 123/339.14; 123/339.19

(58) Field of Search ..... 123/339.12, 339.1, 123/339.11, 339.14, 339.19, 339.23, 179.15, 406.33, 406.55, 406.5, 436; 701/110, 111

(56) References Cited

U.S. PATENT DOCUMENTS

| | | | | | |
|---|---|---|---|---|---|
| 4,344,397 | A | * | 8/1982 | Geiger et al. | 123/339.19 |
| 4,378,770 | A | | 4/1983 | Ikeura | 123/406.53 |
| 4,513,711 | A | * | 4/1985 | Braun et al. | 123/339.12 |
| 4,653,452 | A | | 3/1987 | Sawada et al. | 70/34 |
| 5,081,973 | A | * | 1/1992 | Minamitani | 123/339.12 |
| 5,586,534 | A | * | 12/1996 | Fujimoto | 123/339.23 |
| 5,615,660 | A | | 4/1997 | Iwano et al. | 123/680 |
| 6,152,105 | A | * | 11/2000 | Nishimura et al. | 123/339.11 |
| 6,212,879 | B1 | * | 4/2001 | Nishimura et al. | 60/274 |

FOREIGN PATENT DOCUMENTS

| | | | | |
|---|---|---|---|---|
| EP | 1048838 A2 | * | 2/2000 | F02D/41/16 |
| JP | 362032250 A | * | 2/1987 | F02D/41/00 |
| JP | 05222997 | | 8/1993 | |
| JP | 06-101609 | | 4/1994 | |
| JP | 07-071293 | | 3/1995 | |
| JP | 09-303189 | | 11/1997 | |
| JP | 10-009030 | | 1/1998 | |
| JP | 10-030480 | | 2/1998 | |
| JP | 10-148154 | | 6/1998 | |
| JP | 2001-59438 | | 3/2001 | |

OTHER PUBLICATIONS

Derwent–Acc–No: 2001–277214, Copyright 1999, Derwent Information Ltd, "Automatic Startup Controller for IC Engine, Effects Fuel Supply Control Whenever Engine RPM Exceeds Target After Idling RPM Engine Starting, to Revert Back to Target Idling Speed".

Honda R & D Technical Review, vol. 11, No. 1, Apr. 1999.

* cited by examiner

*Primary Examiner*—John Kwon
*Assistant Examiner*—Hieu T Vo
(74) *Attorney, Agent, or Firm*—Oblon, Spivak, McClelland, Maier & Neustadt, P.C.

(57) ABSTRACT

In control apparatus and method of an internal combustion engine, an engine speed change-to-throttle opening change ratio rdlnetha, that is, a ratio of the amount of change in the engine rotation speed dine to the amount of change in the extent of opening of a throttle valve being under the feedback control, is determined. It is determined whether the engine speed change-to-throttle opening change ratio rdlnetha is within a predetermined range. If the determination is negative, a flag xnedown indicating an imperfect combustion state is turned on. Then, the intake air flow feedback control is stopped, and the control is switched to an ignition timing feedback control or an fuel injection amount feedback control. Therefore, the occurrence of the imperfect combustion state during the feedback control of the engine idle speed can be precisely detected.

18 Claims, 10 Drawing Sheets

FIG. 12

| dltne(rpm) | -50 | 0 | +50 |
|---|---|---|---|
| dlmq(l/m) | +ΔA | 0 | -ΔA |

FIG. 13

| dltne(rpm) | -50 | 0 | +50 |
|---|---|---|---|
| dlmia(°CA) | +ΔB | 0 | -ΔB |

FIG. 14

| dltne(rpm) | -50 | 0 | +50 |
|---|---|---|---|
| dlmtau(sec) | +ΔC | 0 | -ΔC |

INTERNAL COMBUSTION ENGINE CONTROL APPARATUS AND METHOD

INCORPORATION BY REFERENCE

The disclosure of Japanese Patent Application No. HEI 11-119239 filed on Apr. 27, 1999 including the specification, drawings and abstract is incorporated herein by reference in its entirety.

BACKGROUND OF THE INVENTION

1. Field of the Invention

The present invention relates to an internal combustion engine control apparatus and, more particularly, to a control apparatus and a control method for controlling the rotation speed of an automotive internal combustion engine during an idling steady state (a generally-termed idling state, excluding the rising of the engine rotation speed immediately following startup of the engine, and a coasting state) to a target value.

2. Description of the Related Art

For reduced atmospheric pollution, various automotive technologies have been and are being developed to reduce emissions. In particular, there is a strong demand that the engine rotation speed during the idling state, that is, the idle speed, of the internal combustion engine be appropriately controlled so as not to vary but to conform to a target value, because the idling state of the internal combustion engine frequently occurs during actual driving, and has a great effect on emission quality.

Japanese Patent Application Laid-Open No. HEI 5-222997 discloses an apparatus for controlling the engine idle speed. This apparatus performs feedback control with respect to the amount of intake air (intake air flow) and the ignition timing so as to set the engine rotation speed to a target value during the idle operation. When the intake air flow feedback control system fails, the feedback control based on the ignition timing is performed. During cold engine operation, the feedback control based on the ignition timing is limited.

However, if the intake air flow is changed in a case where an imperfect combustion state occurs during a cold state that follows a cold startup and precedes the completion of an engine warm-up, the combustion state further deteriorates in some cases for the following reasons. That is, an imperfect combustion state occurs during the cold state because fuel spraying becomes imperfect so that fuel deposits on intake port wall surfaces or the like and, therefore, a sufficient amount of fuel is not introduced into the combustion chamber. In such a case, the air-fuel ratio shifts to the fuel-lean side. If the throttle opening is enlarged to increase the intake air flow and therefore increase the engine torque, the negative pressure in the intake pipe decreases, so that the fuel spraying quality further deteriorates. The air-fuel ratio thus further shifts to the lean side.

In order to properly control the engine idle speed so as to conform to a target value, it is critical to precisely detect the above-described situation. However, no description regarding such detection or the like is disclosed in the aforementioned laid-open patent application.

SUMMARY OF THE INVENTION

Accordingly, it is an object of the invention to provide a control apparatus and a control method of an internal combustion engine that are capable of precisely detecting the occurrence of an imperfect combustion state during feedback control of the engine idle speed.

To achieve the above and other objects of the invention, a control apparatus of an internal combustion engine in accordance with one aspect of the invention includes a plurality of feedback control means for controlling an engine idle speed to a target value, a selection means for selecting optimal feedback control means from the plurality of feedback control means in accordance with a condition, and for controlling the idle speed by using the optimal feedback control means selected, and a determination means for determining that an imperfect combustion state based on the feedback control means selected by the selection means has occurred, if during a feedback control of the idle speed performed by the feedback control means selected by the selection means, an engine speed change-to-control amount change ratio that is a degree of a change in the engine speed with respect to a change in an amount of control of the feedback control means, is out of a predetermined range.

The thus-constructed control apparatus of the invention has a plurality of feedback control means capable of controlling the engine idle speed to a target value, and determines whether an imperfect combustion state has occurred during a feedback control of the idle speed performed by a feedback control means selected in accordance with the condition. Therefore, the control apparatus is able to determine whether the selected feedback control means is appropriate or inappropriate under the present condition.

In accordance with second aspect of the invention, a control apparatus of an internal combustion engine includes a plurality of feedback control means for controlling an engine idle speed to a target value, a selection means for selecting optimal feedback control means from the plurality of feedback control means in accordance with a condition, and for controlling the idle speed by using the optimal feedback control means selected, and a first determination means for, during a feedback control of the idle speed performed by the feedback control means selected by the selection means, determining an engine speed deviation that is a deviation of an actual engine speed from a target engine speed, and for, if the engine speed deviation exceeds a predetermined criterion, determining that an imperfect combustion state based on the feedback control means selected by the selection means has occurred.

As in the first aspect of the invention, the control apparatus in accordance with the second aspect of the invention has a plurality of feedback control means capable of controlling the engine idle speed to a target value, and determines whether an imperfect combustion state has occurred during a feedback control of the idle speed performed by a feedback control means selected in accordance with the condition. Therefore, the control apparatus is able to determine whether the selected feedback control means is appropriate or inappropriate under the present condition.

In accordance with third aspect of the invention, a control apparatus of an internal combustion engine includes a plurality of feedback control means for controlling an engine idle speed to a target value, a selection means for selecting optimal feedback control means from the plurality of feedback control means in accordance with a condition, and for controlling the idle speed by using the optimal feedback control means selected, and a first determination means for, during a feedback control of the idle speed performed by the feedback control means selected by the selection means, determination means for determining that the imperfect combustion state based on the feedback control means selected by the selection means has occurred if an adjusted value of control of the feedback control means being operated, the adjusted value having been adjusted in accordance with the engine speed deviation, exceeds a predetermined limit.

The control apparatus in accordance with either one of the first, second and third aspects of the invention may be constructed so that if it is determined that the imperfect combustion state based on the feedback control performed by the feedback control means selected by the selection means has occurred, a predetermined other feedback control means is selected instead of the feedback control means already selected. This construction makes it possible to switch the present feedback control to the feedback control performed by a predetermined other feedback control means if the imperfect combustion state occurs during the present feedback control. Thus, it becomes possible to avoid continuation of the imperfect combustion state caused by the presently selected feedback control means.

In accordance with still another aspect of the invention, there is provided a control method of an internal combustion engine, in which a feedback control means is selected from a plurality of feedback control means, and the selected feedback control means is used to control the idle speed, and an engine speed change-to-control amount change ratio that is a degree of a change in the engine speed with respect to a change in an amount of control of the feedback control means selected is determined during a feedback control of the idle speed performed by the feedback control means selected, and it is determined that an imperfect combustion state based on the feedback control means selected has occurred if the engine speed change-to-control amount change ratio is out of a predetermined range.

In a control method of an internal combustion engine in accordance with a farther aspect of the invention, a feedback control means is selected from a plurality of feedback control means, and the selected feedback control means is used to control the idle speed. Furthermore, an engine speed deviation that is a deviation of an actual engine speed from a target engine speed is determined during a feedback control of the idle speed performed by the feedback control means selected. If the engine speed deviation determined exceeds a predetermined criterion, it is determined that an imperfect combustion state based on the feedback control means selected has occurred.

BRIEF DESCRIPTION OF THE DRAWINGS

The foregoing and further objects, features and advantages of the present invention will become apparent from the following description of preferred embodiments with reference to the accompanying drawings, wherein like numerals are used to represent like elements and wherein:

FIG. 12 shows a map of the amount of adjustment of intake air flow with respect to the engine speed deviation that is used in the control of the modification of the first embodiment;

FIG. 13 shows a map of the amount of adjustment of ignition timing with respect to the engine speed deviation that is used in the control of the modification of the second embodiment; and FIG. 14 shows a map of the amount of adjustment of fuel injection amount with respect to the engine speed deviation that is used in the control of the modification of the third embodiment.

DETAILED DESCRIPTION OF PREFERRED EMBODIMENTS

Preferred embodiments of the invention will be described in detail hereinafter with reference to the accompanying drawings.

Figure 1:
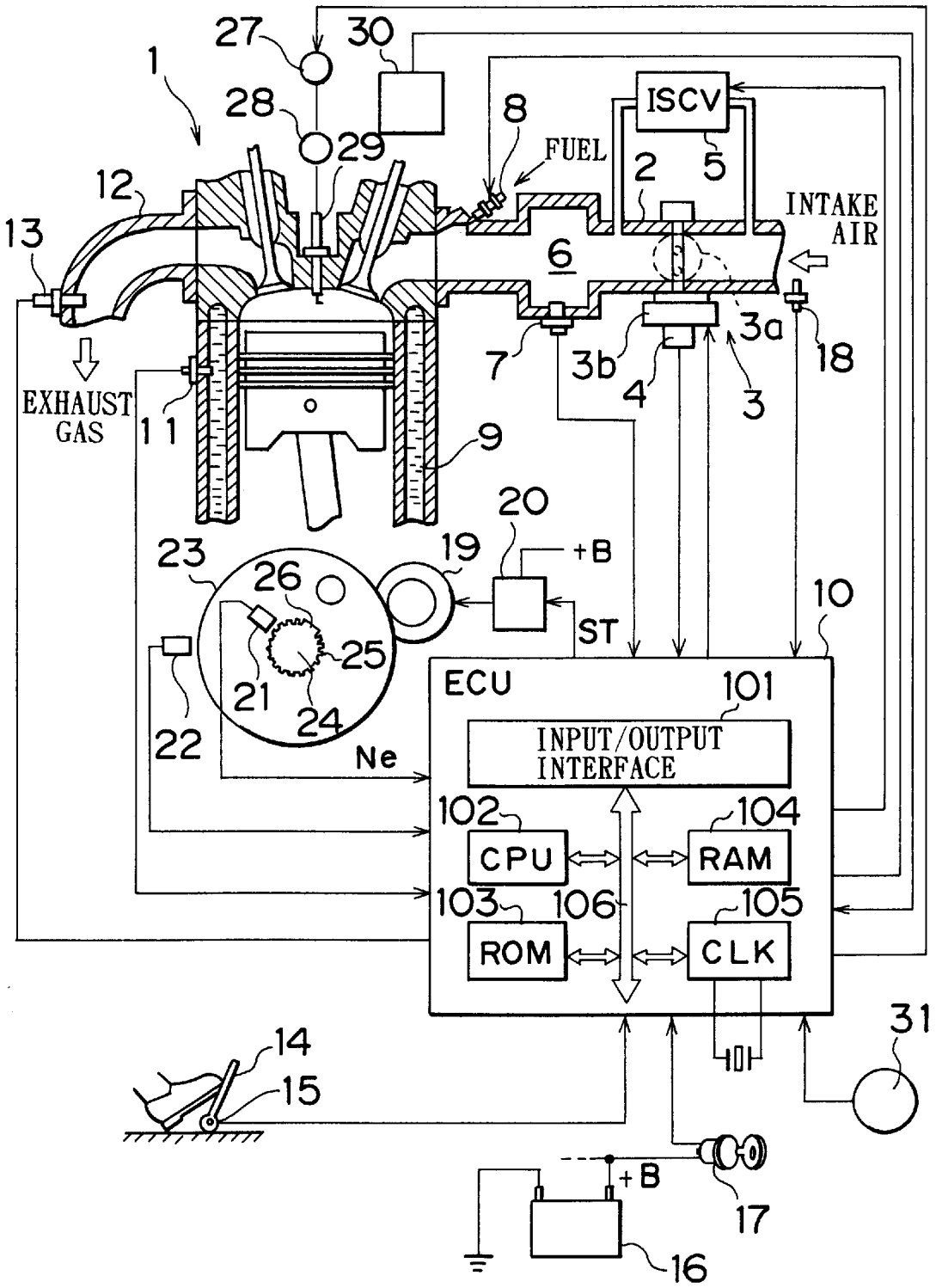
FIG. 1 is an illustration of a hardware construction common to the preferred embodiments of the invention.

FIG. 1 is a schematic illustration of a hardware construction that is common to the preferred embodiments described below. Referring to FIG. 1, an internal combustion engine 1 has an electronically controlled throttle 3 that is disposed in a portion of an intake passage 2 that extends downstream of an air cleaner (not shown). A throttle valve 3*a* of the electronically controlled throttle 3 is driven in the opening and closing directions by a throttle motor 3*b*. When an opening extent instruction value from an engine control unit (ECU) 10 is inputted to the electronically controlled throttle 3, the throttle motor 3*b* drives the throttle valve 3*a* to achieve the instructed extent of opening in response to the instruction value.

The extent of opening of the throttle valve 3*a* is controlled over a range between a completely closed state indicated by a solid line and a fully open state indicated by a broken line in FIG. 1. The opening extent of the throttle valve 3*a* is detected by a throttle opening sensor 4. The instructed extent of opening of the throttle valve 3*a* is determined in accordance with an accelerator pedal depression amount-indicating signal (accelerator operation amount signal) from an accelerator pedal depression sensor 15 that is provided on an accelerator pedal 14 for detecting the amount of depression of the accelerator pedal 14.

Although the intake air flow (amount of intake air) during idling of the internal combustion engine can be sufficiently controlled by using the electronically controlled throttle 3, the control of intake air flow during idling may also be performed by using an idle speed control valve (hereinafter, referred to as "ISCV") 5 that is provided in a bypass passage around the throttle valve 3*a* as shown in FIG. 1.

An atmospheric pressure sensor 18 is provided in a portion of the intake passage 2 that extends upstream of the electronically controlled throttle 3. A surge tank 6 for preventing intake pulsation in the internal combustion engine is provided downstream of the electronically controlled throttle 3. A pressure sensor 7 is provided in the surge tank 6 for detecting the pressure of intake air. Disposed downstream of the surge tank 6 are fuel injection valves 8 for supplying pressurized fuel from a fuel supplying system into corresponding cylinder intake ports. The ignition of an engine fuel is performed by an igniter 27 causing electric discharge from ignition plugs 29 through the use of an ignition all coil 28 based on signals from the ECU 10.

A water temperature sensor 11 for detecting the temperature of cooling water of the internal combustion engine 1 is provided in a cooling water passage 9 formed in a cylinder block of the internal combustion engine 1. The water temperature sensor 11 generates an analog voltage signal corresponding to the temperature of cooling water. An exhaust passage 12 is provided with a three-way catalytic converter (not shown) for simultaneously removing three major harmful components, that is, HC, CO and NOx, from exhaust gas. An $O_2$ sensor 13, which is a kind of air-fuel ratio sensor, is provided in a portion of the exhaust passage 12 that extends upstream of the catalytic converter. The $O_2$ sensor 13 generates an electric signal corresponding to the concentration of oxygen components in exhaust gas. The signals from the various sensors are inputted to the ECU 10.

The ECU 10 also accepts input of a key position signal (indicating an accessory position, an on position, a starter position, and the like) from an ignition switch 17 connected to a battery 16, input of a top dead center signal TDC and a crank angle signal CA generated at every predetermined angle which are outputted from a crank angle position sensor 21 provided adjacent to a timing rotor 24 that is firmly connected to or formed together with a crankshaft timing pulley connected to an end of a crankshaft, input of a reference position signal from a cam position sensor 30, input of the lubricant temperature from an oil temperature sensor 22, and input of a vehicle speed signal from a vehicle speed sensor 31 provided in a transmission (not shown). A ring gear 23 connected to the other end of the crankshaft is rotated by a starter 19 during startup of the internal combustion engine 1.

When the internal combustion engine 1 is started to operate, the ECU 10 is energized to activate programs. The ECU 10 then receives outputs of the various sensors, and controls the throttle motor 3*b*, the ISCV 5, the fuel injection valves 8, the timing rotor 24 and other actuators. To this end, the ECU 10 has A/D converters for converting analog signals from the various sensors into digital signals, an input/output interface 101 for input of signals from the various sensors and output of drive signals to the various actuators, a CPU 102, memory such as a ROM 103, a RAM 104 and the like, a clock 105, and the like. These components of the ECU 10 are interconnected by a bus 106.

The detection of engine rotation speed ne and the cylinder discrimination will be described.

The timing rotor 24 has signal teeth 25 that are arranged substantially at every 10° with a two-teeth deleted portion 26 formed for detecting the top dead center. Therefore, the total number of signal teeth 25 of the timing rotor 24 is thirty four. The crank angle position sensor 21 is formed by an electromagnetic pickup, and outputs a crank rotation signal at every turn of 10°. The engine rotation speed ne is detected by measuring an interval (time) between crank angle signals.

The cam position sensor 30 is provided on a camshaft that turns 360° for every 720° turn of the crankshaft. The cam position sensor 30 is designed so as to generate a reference signal at, for example, the top dead center of the first cylinder. The discrimination of an imperfect-combustion cylinder in the first embodiment (described below) is performed by measuring the elapsed time from the reference signal generated by the cam position sensor 30.

Controls according to embodiments of the invention having the above-described hardware construction will be described below.

The embodiments will be described in a case where the feedback control of the engine rotation speed is performed based on one control index, and the combustion state becomes imperfect during the control, and the feedback control is switched to the feedback control based on another control index. The following three feedback control switching manners can be conceived.

(1) An imperfect combustion occurs during an intake air flow feedback control, and the control is switched to an ignition timing feedback control or a fuel injection amount feedback control.

(2) An imperfect combustion occurs during the ignition timing feedback control, and the control is switched to the fuel injection amount feedback control.

(3) An imperfect combustion occurs during the fuel injection amount feedback control, and the control is switched to the ignition timing feedback control.

The switching from the ignition timing feedback control or the fuel injection amount feedback control to the intake air flow feedback control is not mentioned above for the following reasons. Normally, the intake air flow feedback control is performed considering the effects on the emission quality or the like. The cases where the ignition timing feedback control or the fuel injection amount feedback control is performed are mostly cases where an imperfect combustion occurs during the intake air flow feedback control, and the control is switched. If the intake air flow feedback control is performed again in such a case, an imperfect combustion state will likely occur.

The following two methods of determining whether the imperfect combustion state has occurred can be conceived.

(a) The determination is performed based on the ratio of the amount of change in the engine rotation speed to the amount of change in the control index.

(b) The determination is performed based on the deviation of the engine rotation speed from a target value.

Therefore, the embodiments described below are:

- a first embodiment that uses control index (1)+control method (a);
- a modification of the first embodiment that uses control index (1)+determining method (b);
- a second embodiment that uses control index (2)+control method (a);
- a modification of the second embodiment that uses control index (2)+determining method (b);
- a third embodiment that uses control index (3)+control method (a);
- a modification of the third embodiment that uses control index (3)+determining method (b); and
- a fourth embodiment that uses control index (1)+determining method (a)+cylinder discrimination.

FIRST EMBODIMENT

In the first embodiment, if the imperfect combustion state occurs during the intake air flow feedback control, the control is switched to the ignition timing feedback control or the fuel injection amount feedback control. Whether the imperfect combustion state during the intake air flow feedback control has occurred is determined based on the ratio of the amount of change in the engine rotation speed to the amount of change in the intake air flow.

Figure 2:
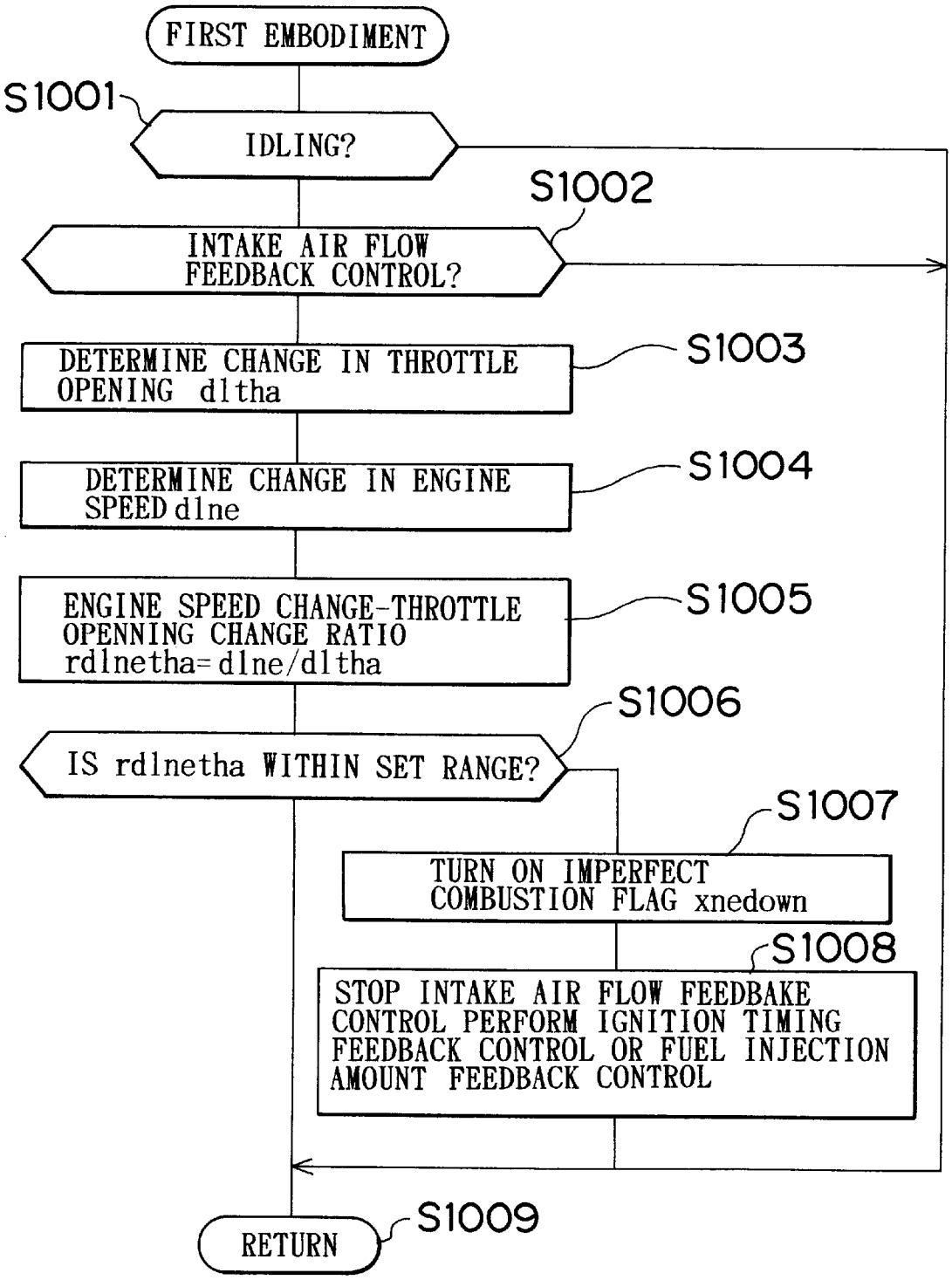
FIG. 2 is a flowchart illustrating a control operation according to a first embodiment of the invention.

FIG. 2 is a flowchart illustrating a control operation according to the first embodiment. In step 1001 in FIG. 2, the ECU 10 determines whether the internal combustion engine 1 is in the idle state, based on the signal from the throttle opening sensor 4 or the accelerator pedal depression sensor 15 and the signal from the vehicle speed sensor 31. In step 1002, the ECU 10 determines whether the intake air flow feedback control is being performed. If the determination is negative in either one of steps 1001 and 1002, the process jumps to step 1009 to return, without any further processing performed. If the determination is affirmative in both steps 1001 and 1002, the ECU 10 determines in steps 1003–1005 an engine speed change-to-throttle opening change ratio rdlnetha, that is, a ratio of the amount of change in the engine rotation speed dine to the amount of change in the extent of opening of the throttle valve 3a under the feedback control.

Figure 9:
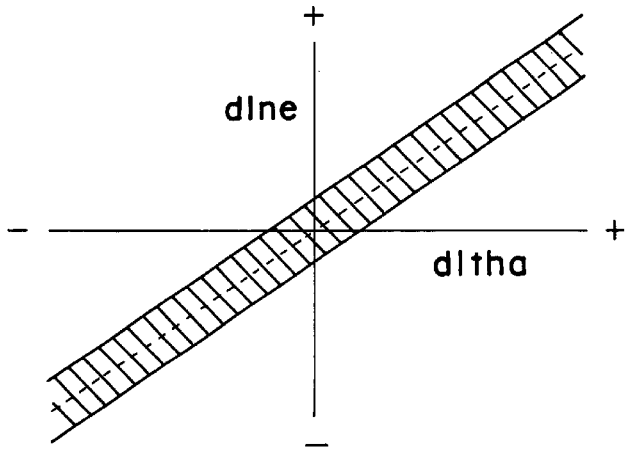
FIG. 9 indicates an engine speed change-to-throttle opening change ratio map used in the control of the first embodiment.

Subsequently in step 1006, the ECU 10 determines whether the engine speed change-to-throttle opening change ratio rdlnetha is within a predetermined range. FIG. 9 indicates a map used for the determination in step 1006 as to whether the engine speed change-to-throttle opening change ratio rdlnetha is within the predetermined range. In the map of FIG. 9, the horizontal axis indicates the amount of change in the throttle opening extent dltha, and the vertical axis indicates the amount of change in the engine rotation speed dine. The region in which the combustion is good and the intake air flow feedback control is performed well is indicated by hatching in FIG. 9.

If the determination is affirmative in step 1006, it is considered that the amount of change in the engine rotation speed dine is normal with respect to the amount of change in the throttle opening extent dltha, that is, it is considered that the combustion state is good. Therefore, the process immediately goes to step 1009 to return, without any further processing being executed. Thus, the intake air flow feedback control continues without being switched to another feedback control.

If the determination is negative in step 1006, it is considered that the amount of change in the engine rotation speed dine is abnormal with respect to the amount of change in the throttle opening extent dltha, that is, it is considered that the combustion state is not good. The process then proceeds to step 1007, in which a flag xnedwn indicating the imperfect combustion state is turned on. Subsequently in step 1008, the ECU 10 stops the intake air flow feedback control, and causes the ignition timing feedback control or the fuel injection amount feedback control to be started. The process then proceeds to step 1009 to return.

Thus, in the first embodiment, when the engine speed change-to-throttle opening change ratio rdlnetha during the intake air flow feedback control is out of the predetermined range, it is determined that the combustion state is not good. Then, the intake air flow feedback control is stopped, and the ignition timing feedback control or the fuel injection amount feedback control is performed.

MODIFICATION OF FIRST EMBODIMENT

In the modification of the first embodiment, if the imperfect combustion state occurs during the intake air flow feedback control, the control is switched to the ignition timing feedback control or the fuel injection amount feedback control, as in the first embodiment. In the modification, however, whether the imperfect combustion state has occurred is determined based on the deviation of the engine rotation speed from a target value.

Figure 3:
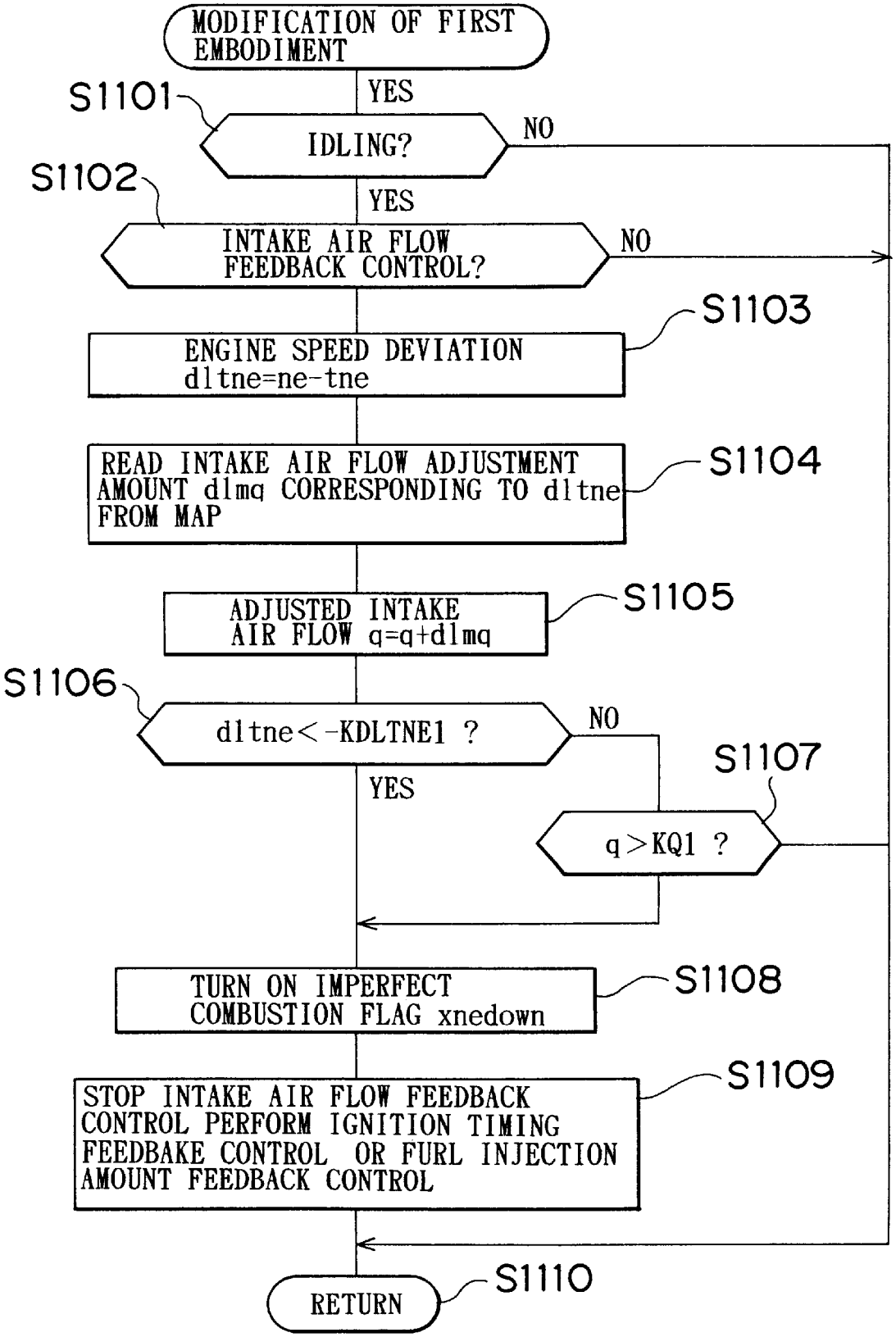
FIG. 3 is a flowchart illustrating a control operation according to a modification of the first embodiment.

FIG. 3 is a flowchart illustrating a control operation according to the modification of the first embodiment. Steps 1101, 1102 in FIG. 3 are the same as steps 1001, 1002 in the first embodiment in FIG. 2, and therefore will not be described again. If the determination is negative in either one of steps 1101, 1102, the process jumps to step 1110 to return, without any further processing being executed. If the determination is affirmative in both steps 1101, 1102, the process proceeds to step 1103.

In step 1103, the ECU 10 determines an engine speed deviation dltne, that is, a difference between the actual engine rotation speed ne and a target engine rotation speed tne. Subsequently in step 1104, the ECU 10 determines an intake air flow adjustment amount dlmq corresponding to the engine speed deviation dltne with reference to a map.

An example of the map is shown in FIG. 12, in which the proportion of the amount by which the intake air flow needs to be increased or decreased is pre-set in relation to the engine speed deviation dltne. In the map shown in FIG. 12, the intake air flow adjustment amount dlmq is set to $+\Delta A$ (L/m) if the actual engine rotation speed ne is at least 50 rpm lower than the target engine rotation speed tne, and $-\Delta A$ (L/m) if the actual engine rotation speed ne is at least 50 rpm higher than the target engine rotation speed tne. The engine speed deviation, which determines the amount of adjustment of the intake air flow is not limited to the values shown in FIG. 12. An increased number of adjustment amounts (four or more adjustment amounts) may also be set in relation to the deviation of the engine rotation speed. The intake air flow adjustment amount may also be determined by using a relationship expression between the engine rotation speed deviation and the adjustment amount, instead using of the map.

Subsequently in step 1105, the ECU 10 determines a adjusted intake air flow q by adding the intake air flow adjustment amount dlmq determined in step 1104 to the present intake air flow q. The process then proceeds to step 1106.

In step 1106, the ECU 10 determines whether the engine speed deviation dltne determined in step 1104 is less than a predetermined criterion −KDLTNE1. If the determination in step 1106 is affirmative, it means that the actual engine rotation speed ne is considerably lower than the target engine rotation speed tne, that is, the combustion state based on the intake air flow feedback control is not good. The process then proceeds to step 1108, in which the ECU 10 turns on the flag xnedwn indicating the imperfect combustion state. Subsequently in step 1109, the ECU 10 stops the intake air flow feedback control, and causes the ignition timing feedback control or the fuel injection amount feedback control to be started. The process then returns in step 1110.

Conversely, if the determination is negative in step 1106, the process proceeds to step 1107, in which the ECU 10 determines whether the adjusted intake air flow q exceeds an upper limit KQ1. If the determination in step 1107 is affirmative, it means that although the engine rotation speed deviation is small, an intake air flow greater than the upper limit KQ1 has been supplied to the engine, and the intake air flow q cannot be increased any further. In this case, too, the process proceeds to step 1108, in which the ECU 10 turns on the flag xnedwn indicating the imperfect combustion state. Subsequently in step 1109, the ECU 10 stops the intake air flow feedback control, and causes the ignition timing feedback control or the fuel injection amount feedback control to be started. The process then returns in step 1110.

If the determination is negative in step 1107, it means that the engine speed deviation dltne is equal to or less than the criterion and that the intake air flow q can be further increased. Therefore, the process jumps to step 1110 to return, without any further processing being executed. Thus, the intake air flow feedback control continues without being switched to another feedback control.

Thus, in the modification of the first embodiment, if the engine speed deviation dltne based on the intake air flow feedback control is out of the predetermined range, or if the intake air flow adjusted based on the engine speed deviation dltne exceeds the upper limit value, it is determined that the combustion state based on the intake air flow feedback control is not good. Then, the intake air flow feedback control is stopped, and the ignition timing feedback control or the fuel injection amount feedback control is performed.

It is noted herein that in this modification of the first embodiment, determination during the process is executed by using the intake air flow. Therefore, if the intake air flow feedback control is continued, the intake air flow is converted into the extent of the throttle opening, and an instruction regarding the converted value is outputted. Hence, the computations in step 1104, 1105 and 1107 may be performed based on the throttle opening extent instead.

SECOND EMBODIMENT

In the second embodiment, if the imperfect combustion state occurs during the ignition timing feedback control, the control is switched to the fuel injection amount feedback control. Whether the imperfect combustion state during the ignition timing feedback control has occurred is determined based on the ratio of the amount of change in the engine rotation speed to the amount of change in the ignition timing.

Since the intake air flow feedback control is normally performed, for reasons of emissions quality, the occasion when a control operation according to the second embodiment is performed is when the intake air flow feedback control is inappropriate, and control has been switched to the ignition timing feedback control in the first embodiment.

Figure 4:
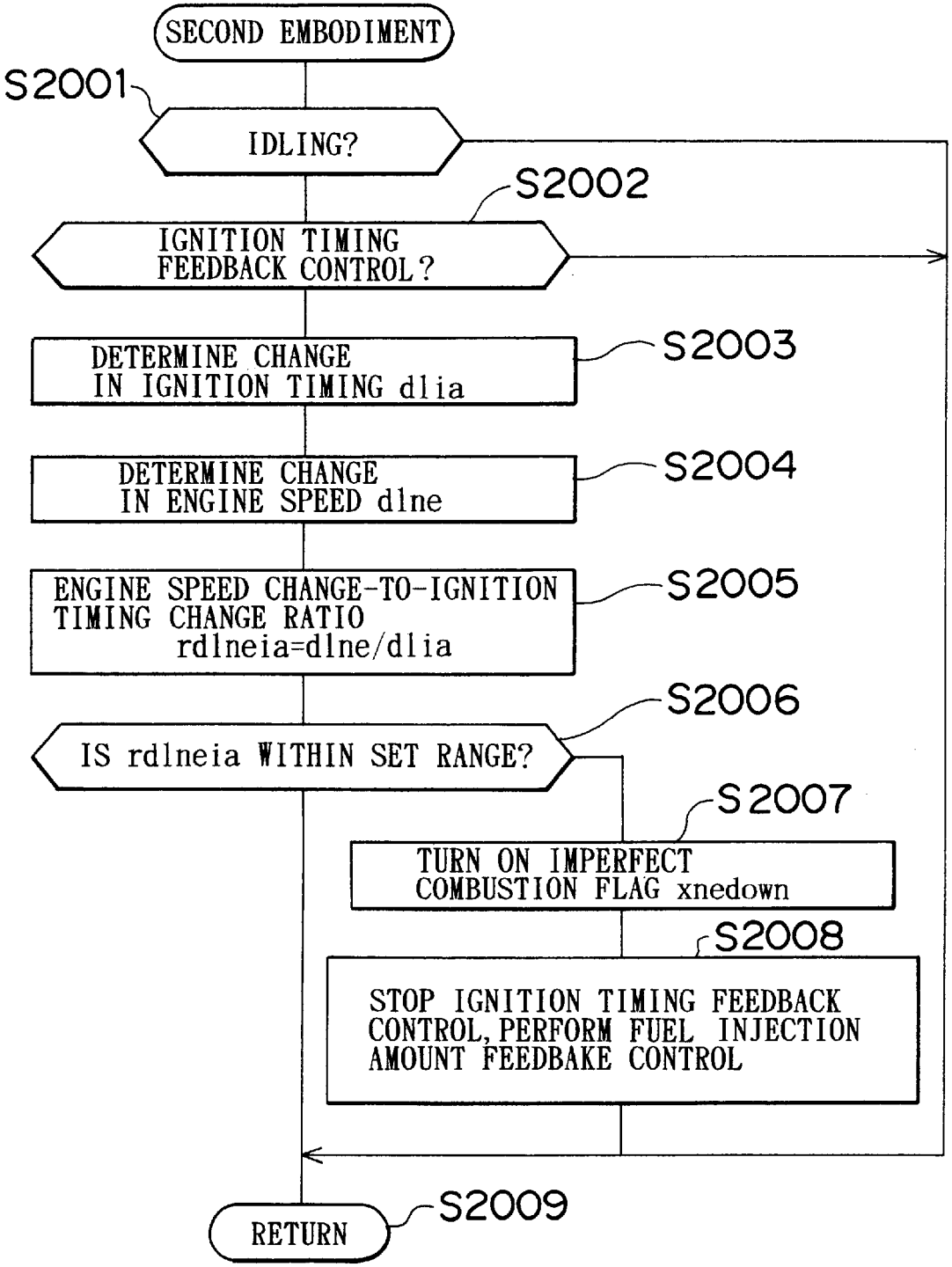
FIG. 4 is a flowchart illustrating a control operation according to a second embodiment of the invention.

FIG. 4 is a flowchart illustrating the control operation according to the second embodiment. The flowchart of FIG. 4 is basically the same as the flowchart of the first embodiment.

In step 2001 in FIG. 4, the ECU 10 determines whether the internal combustion engine 1 is in the idle state as in the first embodiment. In step 2002, the ECU 10 determines whether the ignition timing feedback control is being performed. If the determination is negative in either one of steps 2001 and 2002, the process jumps to step 2009 to return, without any further processing performed. If the determination is affirmative in both steps 2001 and 2002, the ECU 10 determines in steps 2003–2005 an engine speed change-to-ignition timing change ratio rdlneia, that is, a ratio of the amount of change in the engine rotation speed dlne to the amount of change in the ignition timing dlia under the feedback control.

Figure 10:
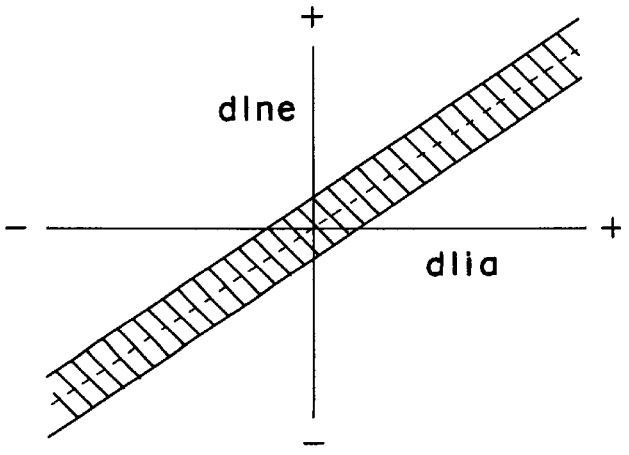
FIG. 10 indicates an engine speed change-to-ignition timing change ratio map used in the control of the second embodiment.

Subsequently in step 2006, the ECU 10 determines whether the engine speed change-to-ignition timing change ratio rdlneia is within a predetermined range. FIG. 10 indicates a map used for the determination in step 2006 as to whether the engine speed change-to-ignition timing change ratio rdlneia is within the predetermined range. In the map of FIG. 10, the horizontal axis indicates the amount of change in the ignition timing dlia, and the vertical axis indicates the amount of change in the engine rotation speed dlne. The region in which the combustion is good and the ignition timing feedback control is performed well is indicated by hatching in FIG. 10.

If the determination is affirmative in step 2006, it is considered that the amount of change in the engine rotation speed dine is normal with respect to the amount of change in the ignition timing dlia, that is, it is considered that the combustion state is good. Therefore, the process immediately goes to step 2009 to return, without any further processing being executed. Thus, the ignition timing feedback control continues to be performed.

If the determination is negative in step 2006, it is considered that the amount of change in the engine rotation speed dine is abnormal with respect to the amount of change in the ignition timing dlia, that is, it is considered that the combustion state based on the ignition timing feedback control is not good. The process then proceeds to step 2007 in which the flag xnedwn indicating the imperfect combustion state is turned on. Subsequently in step 2008, the ECU 10 stops the ignition timing feedback control and causes the fuel injection amount feedback control to be started. The process then proceeds to step 2009 to return.

Thus, in the second embodiment, when the ratio of the amount of change in the engine rotation speed dine to the amount of change in the ignition timing dlia during the ignition timing feedback control is out of the predetermined range, it is determined that the combustion state based on the ignition timing feedback control is not good. Then, the ignition timing feedback control is stopped, and the fuel injection amount feedback control is performed.

MODIFICATION OF SECOND EMBODIMENT

In the modification of the second embodiment, if the imperfect combustion state occurs during the ignition timing feedback control, the control is switched to the fuel injection amount feedback control, as in the second embodiment. In the modification, however, whether the imperfect combustion state has occurred is determined based on the deviation of the engine rotation speed from a target value.

Similar to the second embodiment, the modification of the second embodiment is performed when the intake air flow feedback control is inappropriate and has been switched to the ignition timing in the first embodiment.

Figure 5:
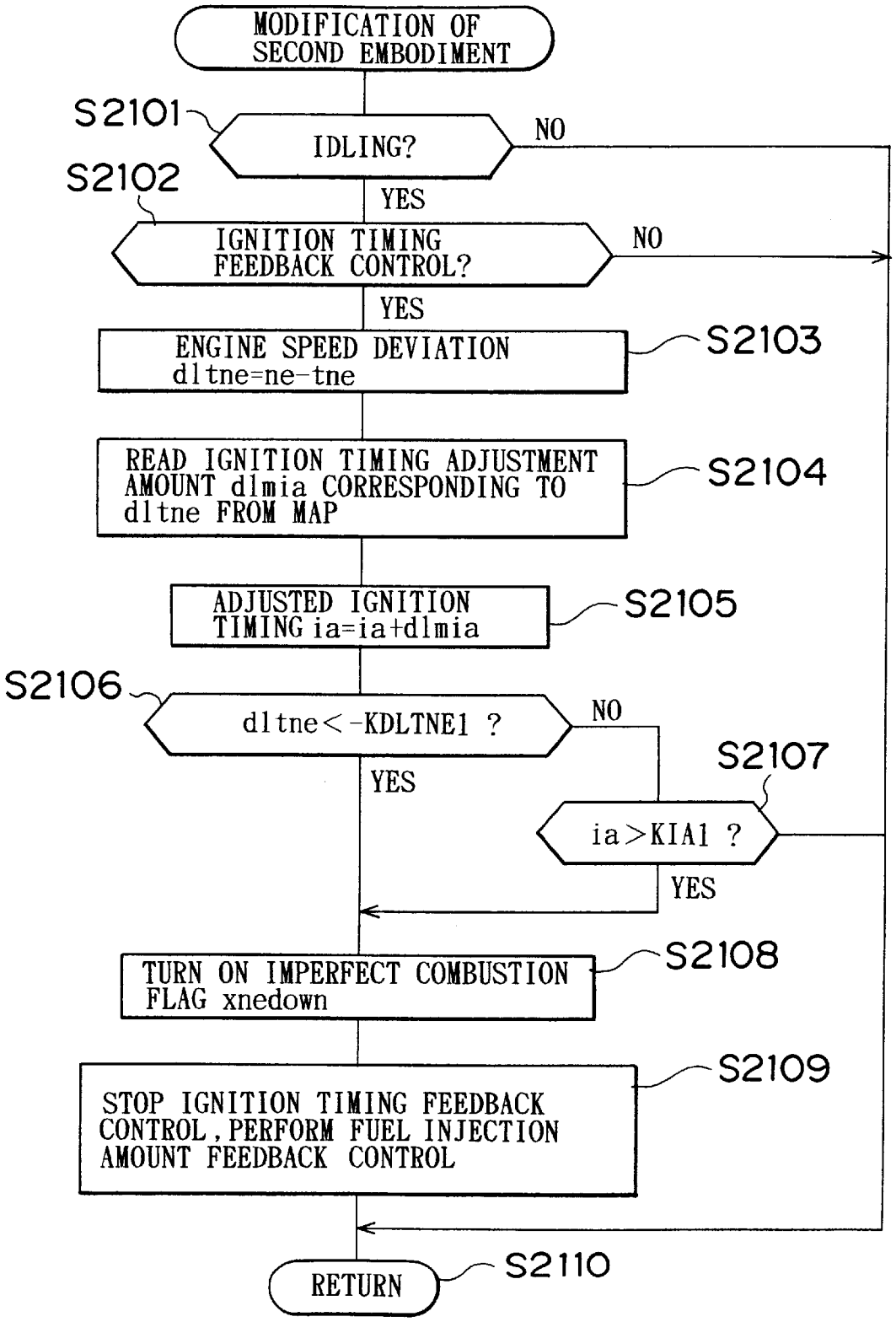
FIG. 5 is a flowchart illustrating a control operation according to a modification of the second embodiment.

FIG. 5 is a flowchart illustrating a control operation according to the modification of the second embodiment. The flowchart of FIG. 5 is basically the same as the flowchart of the modification of the first embodiment.

Steps 2101, 2102 in FIG. 5 are the same as steps 2001, 2002 in the second embodiment, and therefore will not be described again. If the determination is negative in either one of steps 2101, 2102, the process jumps to step 2110 to return, without any further processing being executed. If the determination is affirmative in both steps 2101, 2102, the process proceeds to step 2103.

In step 2103, the ECU 10 determines an engine speed deviation dltne, that is, a difference between the actual engine rotation speed ne and a target engine rotation speed tne. Subsequently in step 2104, the ECU 10 determines an ignition timing adjustment amount (advancement amount) dlmia corresponding to the engine speed deviation dltne with reference to a map.

An example of the map is shown in FIG. 13, in which the amount by which the ignition timing needs to be advanced or delayed is pre-set in relation to the engine speed deviation dltne. In the map shown in FIG. 13, the ignition timing adjustment amount dlmia is set to +ΔB (°CA) if the actual engine rotation speed ne is at least 50 rpm lower than the target engine rotation speed tne, and −ΔB (°CA) if the actual engine rotation speed ne is at least 50 rpm higher than the target engine rotation speed tne. The engine speed deviation, which determines the amount of adjustment of the ignition timing is not limited to the values shown in FIG. 13. An increased number of adjustment amounts (four or more adjustment amounts) may also be set in relation to the engine rotation speed deviation. The ignition timing adjustment amount may also be determined by using a relationship expression between the engine rotation speed deviation and the adjustment amount, instead of using the map.

Subsequently in step 2105, the ECU 10 determines an adjusted ignition timing ia by adding the ignition timing adjustment amount dlmia determined in step 2104 to the present ignition timing ia. The process then proceeds to step 2106.

In step 2106, the ECU 10 determines whether the engine speed deviation dltne determined in step 2104 is less than the predetermined criterion −KDLTNE1. If the determination in step 2106 is affirmative, it means that the actual engine rotation speed ne is considerably lower than the target engine rotation speed tne, that is, the combustion state based on the ignition timing feedback control is not good. The process then proceeds to step 2108, in which the ECU 10 turns on the flag xnedwn indicating the imperfect combustion state. Subsequently in step 2109, the ECU 10 stops the ignition timing feedback control, and causes the fuel injection amount feedback control to be started. The process then returns in step 2110.

Conversely, if the determination is negative in step 2106, the process proceeds to step 2107, in which the ECU 10 determines whether the adjusted ignition timing ia exceeds an upper limit KIA1. If the determination in step 2107 is affirmative, it means that the ignition timing ia cannot be advanced any further. In this case, too, the process proceeds to step 2108, in which the ECU 10 turns on the flag xnedwn indicating the imperfect combustion state. Subsequently in step 2109, the ECU 10 stops the ignition timing feedback control, and causes the fuel injection amount feedback control to be started. The process then returns in step 2110.

If the determination is negative in step 2107, it means that the engine speed deviation dltne is equal to or less than the criterion and that the ignition timing ia can be further advanced. Therefore, the process jumps to step 2110 to return, without any further processing being executed. Thus, the ignition timing feedback control continues without being switched to another feedback control.

Thus, in the modification of the second embodiment, if the engine speed deviation dltne during the ignition timing feedback control is out of the predetermined range, or if the ignition timing adjusted based on the engine speed deviation dltne exceeds the upper limit value, it is determined that the combustion state based on the ignition timing feedback control is not good. Then, the ignition timing feedback control is stopped, and the fuel injection amount feedback control is performed.

THIRD EMBODIMENT

In the third embodiment, if the imperfect combustion state occurs during the fuel injection amount feedback control, the control is switched to the ignition timing feedback control. Whether the imperfect combustion state during the fuel injection amount feedback control has occurred is determined based on the ratio of the amount of change in the engine rotation speed to the amount of change in the quantity of fuel injected.

Since the intake air flow feedback control is normally performed, for reasons of emissions quality, the occasion when a control operation according to the third embodiment is performed is when the intake air flow feedback control is inappropriate and has been switched to the fuel injection amount feedback control in the first embodiment.

Figure 6:
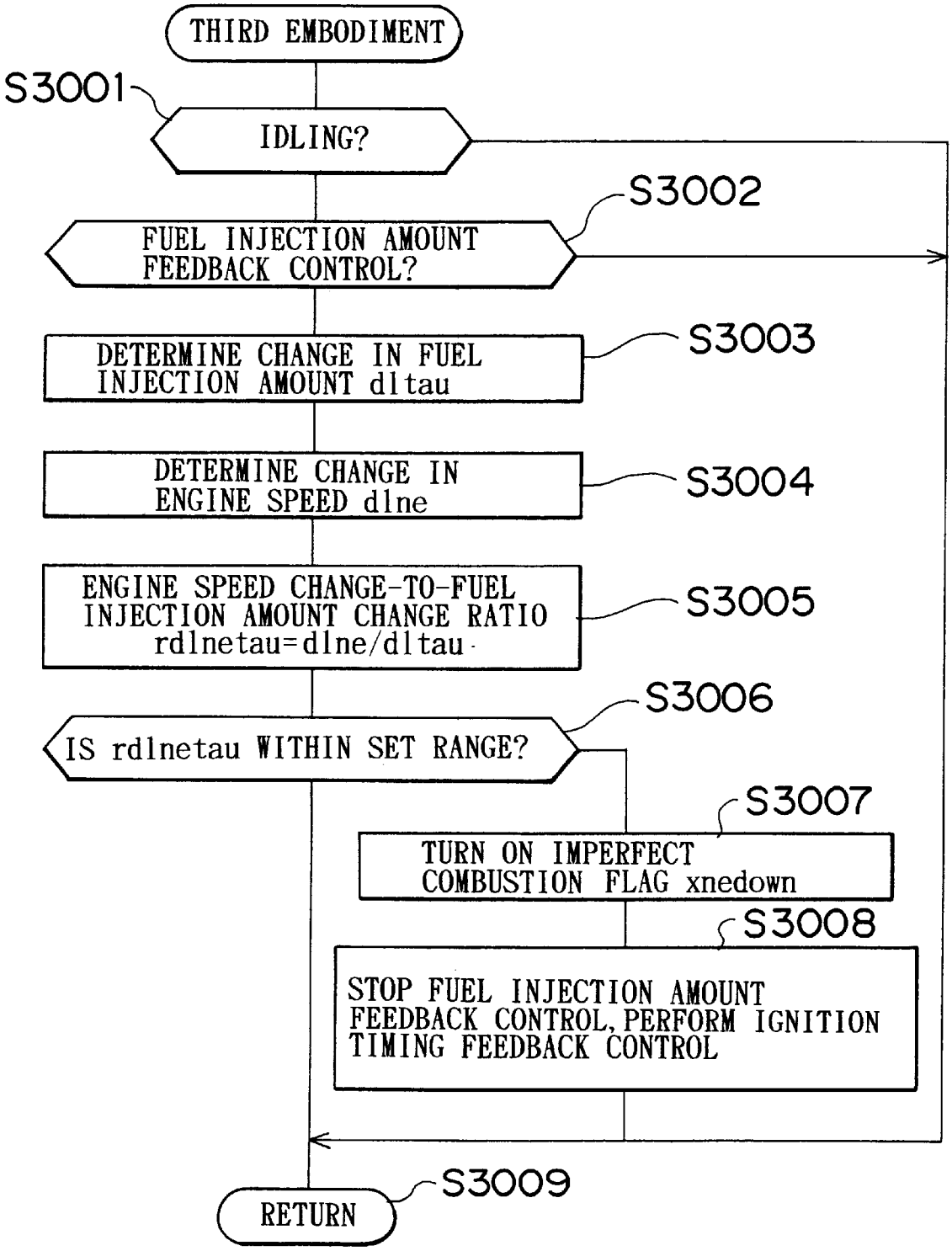
FIG. 6 is a flowchart illustrating a control operation according to a third embodiment of the invention.

FIG. 6 is a flowchart illustrating the control operation according to the third embodiment. The flowchart of FIG. 6 is basically the same as the flowchart of the first embodiment.

In step 3001 in FIG. 6, the ECU 10 determines whether the internal combustion engine 1 is in the idle state as in the first embodiment. In step 3002, the ECU 10 determines whether the fuel injection amount feedback control is being performed. If the determination is negative in either one of steps 3001 and 3002, the process jumps to step 3009 to return, without any further processing performed. If the determination is affirmative in both steps 3001 and 3002, the ECU 10 determines in steps 3003–3005 an engine speed change-to-fuel injection amount change ratio rdlnetau, that is, a ratio of the amount of change in the engine rotation speed dine to the amount of change in the fuel injection amount dltau under the feedback control.

Figure 11:
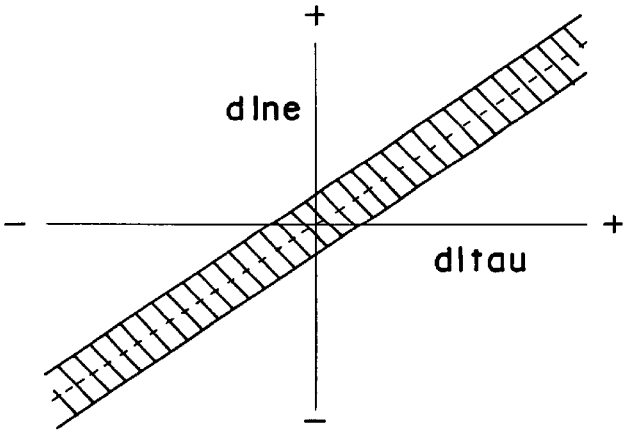
FIG. 11 indicates an engine speed change-to-fuel injection amount change ratio map used in the control of the third embodiment.

Subsequently in step 3006, the ECU 10 determines whether the engine speed change-to-fuel injection amount change ratio rdlnetau is within a predetermined range. FIG. 11 indicates a map used for the determination in step 3006 as to whether the engine speed change-to-fuel injection amount change ratio rdlnetau is within the predetermined range. In the map of FIG. 11, the horizontal axis indicates the amount of change in the amount of fuel injected dltau, and the vertical axis indicates the amount of change in the engine rotation speed dine. The region in which the combustion is good and the feedback control is performed well is indicated by hatching in FIG. 11.

If the determination is affirmative in step 3006, it is considered that the amount of change in the engine rotation speed dine is normal with respect to the amount of change in the fuel injection amount dltau, that is, it is considered that the combustion state is good. Therefore, the process immediately goes to step 3009 to return, without any further processing being executed. Thus, the fuel injection amount feedback control continues to be performed without being switched to another feedback control.

If the determination is negative in step 3006, it is considered that the amount of change in the engine rotation speed dine is abnormal with respect to the amount of change in the fuel injection amount dltau, that is, it is considered that the combustion state based on the fuel injection amount feedback control is not good. The process then proceeds to step 3007, in which the flag xnedwn indicating the imperfect combustion state is turned on. Subsequently in step 3008, the ECU 10 stops the fuel injection amount feedback control, and causes the ignition timing feedback control to be started. The process then proceeds to step 3009 to return.

Thus, in the third embodiment, when the ratio of the amount of change in the engine rotation speed dine to the amount of change in the fuel injection amount dltau during the fuel injection amount feedback control is out of the predetermined range, it is determined that the combustion state based on the fuel injection amount feedback control is not good. Then, the fuel injection amount feedback control is stopped, and the ignition timing feedback control is performed.

MODIFICATION OF THIRD EMBODIMENT

In the modification of the third embodiment, if the imperfect combustion state occurs during the fuel injection amount feedback control, the control is switched to the ignition timing feedback control, as in the third embodiment. In the modification, however, whether the imperfect combustion state has occurred is determined based on the deviation of the engine rotation speed from a target value.

Similar to the third embodiment, the modification of the third embodiment is performed when the intake air flow feedback control is inappropriate and has been switched to the fuel injection amount in the first embodiment.

Figure 7:
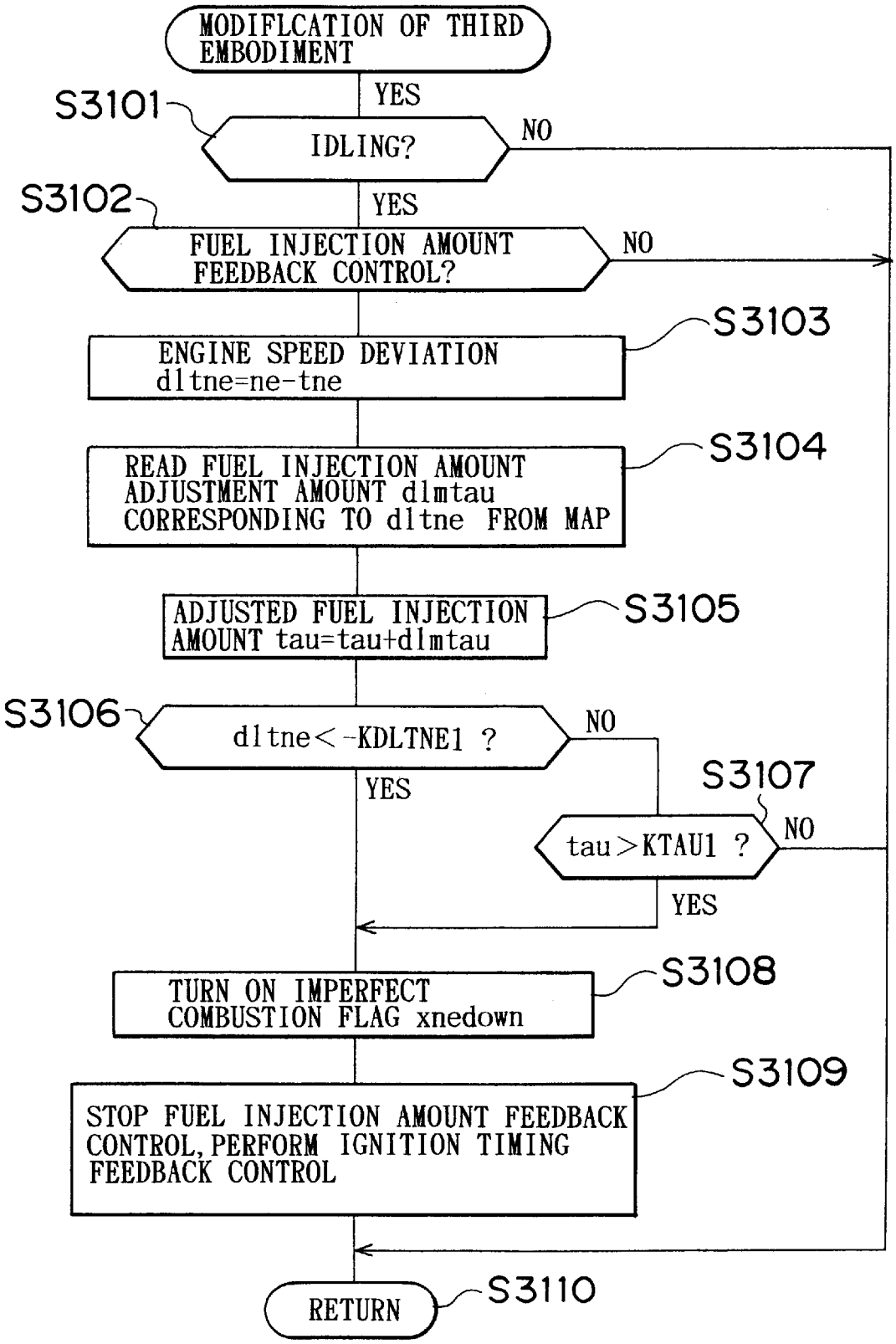
FIG. 7 is a flowchart illustrating a control operation according to a modification of the third embodiment.

FIG. 7 is a flowchart illustrating a control operation according to the modification of the third embodiment. The flowchart of FIG. 7 is basically the same as the flowchart of the modification of the first embodiment.

Steps 3101, 3102 in FIG. 7 are the same as steps 3001, 3002 in the third embodiment, and therefore will not be described again. If the determination is negative in either one of steps 3101, 3102, the process jumps to step 3110 to return, without any further processing being executed. If the determination is affirmative in both steps 3101, 3102, the process proceeds to step 3103.

In step 3103, the ECU 10 determines an engine speed deviation dltne, that is, a difference between the actual engine rotation speed ne and a target engine rotation speed tne. Subsequently in step 3104, the ECU 10 determines a fuel injection amount adjustment amount (injection duration) dlmtau corresponding to the engine speed deviation dltne with reference to a map.

An example of the map is shown in FIG. 14, in which the change amount by which the amount of fuel injected needs to be increased or decreased is pre-set in relation to the engine speed deviation dltne. In the map shown in FIG. 14, the fuel injection amount adjustment amount dlmtau is set to +ΔC (sec.) if the actual engine rotation speed ne is at least 50 rpm lower than the target engine rotation speed tne, and −ΔC (sec.) if the actual engine rotation speed ne is at least 50 rpm higher than the target engine rotation speed tne. The engine speed deviation, which determines the amount of adjustment of the fuel injection amount is not limited to the values shown in FIG. 14. An increased number of adjustment amounts (four or more adjustment amounts) may also be set in relation to the engine rotation speed deviation. The fuel injection amount adjustment amount may also be determined by using a relationship expression between the engine rotation speed deviation and the adjustment amount, instead of using the map.

Subsequently in step 3105, the ECU 10 determines a adjusted fuel injection amount tau by adding the fuel injection amount adjustment amount dlmtau determined in step 3104 to the present fuel injection amount tau. The process then proceeds to step 3106.

In step 3106, the ECU 10 determines whether the engine speed deviation dltne determined in step 3104 is less than the predetermined criterion −KDLTNE1. If the determination in step 3106 is affirmative, it means that the actual engine rotation speed ne is considerably lower than the target engine rotation speed tne, that is, the combustion state based on the fuel injection amount feedback control is not good. The process then proceeds to step 3108, in which the ECU 10 turns on the flag xnedwn indicating the imperfect combustion state. Subsequently in step 3109, the ECU 10 stops the fuel injection amount feedback control, and causes the ignition timing feedback control to be started. The process then returns in step 3110.

Conversely, if the determination is negative in step 3106, the process proceeds to step 3107, in which the ECU 10 determines whether the adjusted fuel injection amount tau exceeds an upper limit KTAU1. If the determination in step 3107 is affirmative, it means that the fuel injection amount tau cannot be increased any further. In this case, too, the process proceeds to step 3108, in which the ECU 10 turns on the flag xnedwn indicating the imperfect combustion state. Subsequently in step 3109, the ECU 10 stops the fuel injection amount feedback control, and causes the ignition timing feedback control to be started. The process then returns in step 3110.

If the determination is negative in step 3107, it means that the engine speed deviation dltne is equal to or less than the criterion and that the fuel injection amount tau can be further increased. Therefore, the process jumps to step 3110 to return, without any further processing being executed. Thus, the fuel injection amount feedback control continues without being switched to another feedback control.

Thus, in the modification of the third embodiment, if the engine speed deviation dltne during the fuel injection amount feedback control is out of the predetermined range, or if the fuel injection amount adjusted based on the engine speed deviation dltne exceeds the upper guard value, it is determined that the combustion state based on the fuel injection amount feedback control is not good. Then, the fuel injection amount feedback control is stopped, and the ignition timing feedback control is performed.

FOURTH EMBODIMENT

In the fourth embodiment, if the imperfect combustion state occurs during the intake air flow feedback control, the control is switched to the ignition timing feedback control or the fuel injection amount feedback control, as in the first embodiment. In the fourth embodiment, however, the cylinder that is experiencing the imperfect combustion is identified.

Figure 8:
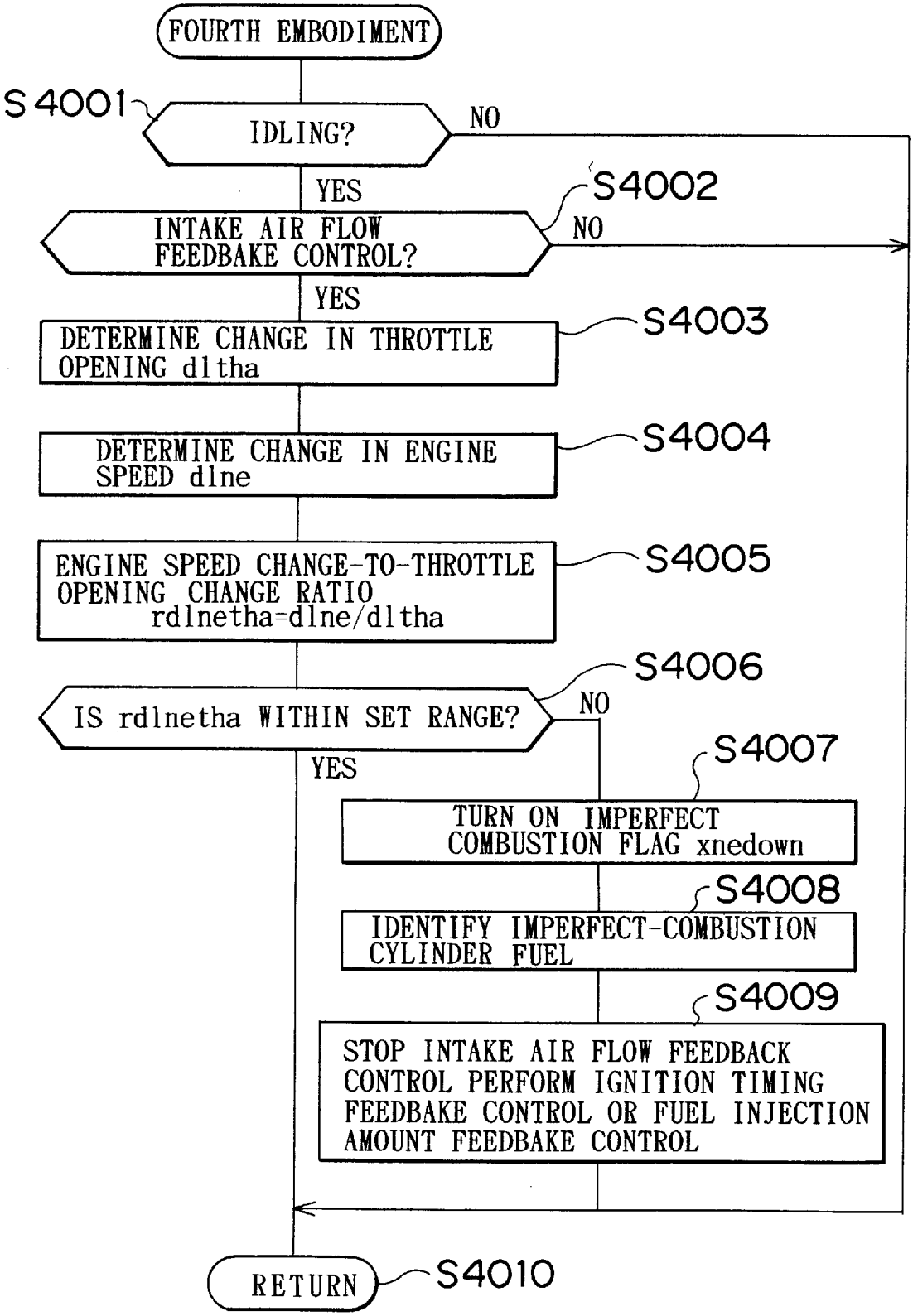
FIG. 8 is a flowchart illustrating a control operation according to a fourth embodiment of the invention.

FIG. 8 is a flowchart illustrating a control operation according to the fourth embodiment, which is substantially the same as the flowchart of the first embodiment shown in FIG. 2, except that step 4008 for identifying an imperfect-combustion cylinder is added.

The identification or discrimination of an imperfect-combustion cylinder can be performed by measuring the time (angle) of the occurrence of a decrease in the engine rotation speed ne from the reference signal from the cam position sensor 30 on the basis of the signal from the crank angle position sensor 21.

In the fourth embodiment, since a cylinder experiencing imperfect combustion is identified as described above, it is possible to switch the control from the intake air flow feedback control to the ignition timing feedback control or the fuel injection amount feedback control only with respect to the imperfect-combustion cylinder. Therefore, the fourth embodiment can prevent deterioration of emissions quality and deterioration of drivability caused by unnecessary changes of control values.

Although in the fourth embodiment, the cylinder identification is added to the first embodiment, the cylinder discrimination may also be added to the second and third embodiments and the modifications thereof.

While the present invention has been described with reference to what are presently considered to be preferred embodiments thereof, it is to be understood that the present invention is not limited to the disclosed embodiments or constructions. On the contrary, the present invention is intended to cover various modifications and equivalent arrangements. In addition, while the various elements of the disclosed invention are shown in various combinations and configurations, which are exemplary, other combinations and configurations, including more, less or only a single embodiment, are also within the spirit and scope of the present invention.

What is claimed is:

1. A control apparatus of an internal combustion engine, comprising:

a plurality of feedback control means for controlling an engine idle speed to a target value;

selection means for selecting optimal feedback control means from the plurality of feedback control means in accordance with a condition, and for controlling the idle speed by using the optimal feedback control means selected; and determination means for determining that an imperfect combustion state of the engine controlled by the feedback control means selected by the selection means has occurred, if during a feedback control of the idle speed performed by the feedback control means selected by the selection means, a ratio of an engine speed change to a change in an amount of control of the feedback control means is out of a predetermined range.

2. A control apparatus of an internal combustion engine according to claim 1, further comprising imperfect-combustion cylinder discriminating means for discriminating a cylinder of the internal combustion engine experiencing the imperfect combustion state.

3. A control apparatus of an internal combustion engine according to claim 1, wherein if it is determined that the imperfect combustion state based on the feedback control performed by the feedback control means selected by the selection means has occurred, the selection means selects a predetermined other feedback control means from the plurality of feedback control means.

4. A control apparatus of an internal combustion engine according to claim 1, wherein the plurality of feedback control means comprise intake air amount feedback control means for performing a feedback control based on an amount of intake air, ignition timing feedback control means for performing a feedback control based on an ignition timing, and fuel injection amount feedback control means for performing a feedback control based on an amount of fuel injected.

5. A control apparatus of an internal combustion engine, comprising:

a plurality of feedback control means for controlling an engine idle speed to a target value;

selection means for selecting optimal feedback control means from the plurality of feedback control means in accordance with a condition, and for controlling the idle speed by using the optimal feedback control means selected; and determination means for, during a feedback control of the idle speed performed by the feedback control means selected by the selection means, determining a deviation of an actual engine speed from a target engine speed, and for, if the engine speed deviation exceeds a predetermined criterion, determining the presence of an imperfect combustion state of the engine controlled by the feedback control means selected by the selection means.

6. A control apparatus of an internal combustion engine according to claim 5, further comprising imperfect-combustion cylinder discriminating means for discriminating a cylinder of the internal combustion engine experiencing the imperfect combustion state.

7. A control apparatus of an internal combustion engine according to claim 5, wherein if it is determined that the imperfect combustion state based on the feedback control performed by the feedback control means selected by the selection means has occurred, the selection means selects a predetermined other feedback control means from the plurality of feedback control means.

8. A control apparatus of an internal combustion engine according to claim 5, wherein the plurality of feedback control means comprise intake air amount feedback control means for performing a feedback control based on an amount of intake air, ignition timing feedback control means for performing a feedback control based on an ignition timing, and fuel injection amount feedback control means for performing a feedback control based on an amount of fuel injected.

9. A control apparatus of an internal combustion engine, comprising:

a plurality of feedback control means for controlling an engine idle speed to a target value;

selection means for selecting optimal feedback control means from the plurality of feedback control means in accordance with a condition, and for controlling the idle speed by using the optimal feedback control means selected; and determination means for determining that the imperfect combustion state of the engine controlled by the feedback control means selected by the selection means has occurred if an adjusted value of control of the feedback control means being operated, the adjusted value having been adjusted in accordance with the engine speed deviation, exceeds a predetermined limit.

10. A control apparatus of an internal combustion engine according to claim 9, further comprising imperfect-combustion cylinder discriminating means for discriminating a cylinder of the internal combustion engine experiencing the imperfect combustion state.

11. A control apparatus of an internal combustion engine according to claim 9, wherein if it is determined that the imperfect combustion state based on the feedback control performed by the feedback control means selected by the selection means has occurred, the selection means selects a predetermined other feedback control means from the plurality of feedback control means.

12. A control apparatus of an internal combustion engine according to claim 9, wherein the plurality of feedback control means comprise intake air amount feedback control means for performing a feedback control based on an amount of intake air, ignition timing feedback control means for performing a feedback control based on an ignition timing, and fuel injection amount feedback control means for performing a feedback control based on an amount of fuel injected.

13. A control method of an internal combustion engine, comprising the steps of:

selecting a feedback control means from a plurality of feedback control means capable of controlling an engine idle speed to a target value;

feedback controlling an idle speed of the engine by using the selected feedback control means;

determining a ratio of an engine speed change to a change in an amount of control of the feedback control means during the step of feedback control of the idle speed performed by the selected feedback control means; and determining the presence of an imperfect combustion state during the feedback control if the engine speed ratio is out of a predetermined range.

14. A control method of an internal combustion engine according to claim 13, further comprising a step of switching the feedback control means selected to predetermined other feedback control means from the plurality of feedback control means, if the presence of the imperfect combustion state based on the feedback control performed by the selected feedback control means is determined.

15. A control method of an internal combustion engine, comprising the steps of:

selecting feedback control means from the plurality of feedback control means capable of controlling an engine idle speed to a target value;

feedback controlling an idle speed of the engine by using the selected feedback control means;

determining a deviation of an actual engine speed from a target engine speed during the feedback control of the idle speed performed by the selected feedback control means selected; and determining the presence of an imperfect combustion state during the step of feedback control, if the determined engine speed deviation exceeds a predetermined criterion.

16. A control method of an internal combustion engine according to claim 15, further comprising the step of switching the feedback control means selected to predetermined other feedback control means from the plurality of feedback control means, if the presence of the imperfect combustion state based on the selected feedback control performed by the feedback control means is determined .

17. A control method of an internal combustion engine, comprising:

using a plurality of feedback control means for controlling an engine idle speed to a target value;

using selection means for selecting optimal feedback control means from the plurality of feedback control means in accordance with a condition, and for controlling the idle speed by using the optimal feedback control means selected; and using determination means for determining that the imperfect combustion state of the engine controlled by the feedback control means selected by the selection means has occurred if an adjusted value of control of the feedback control means being operated, the adjusted value having been adjusted in accordance with the engine speed deviation, exceeds a predetermined limit.

18. A control method of an internal combustion engine according to claim 17, further comprising the step of switching the feedback control means selected to predetermined other feedback control means from the plurality of feedback control means, if the presence of the imperfect combustion state based on the selected feedback control performed by the feedback control means is determined.

* * * * *